US006837036B2

(12) United States Patent
Cerato

(10) Patent No.: US 6,837,036 B2
(45) Date of Patent: Jan. 4, 2005

(54) METHOD OF DECORATING JEWELRY

(75) Inventor: Silverio Cerato, Mussolente (IT)

(73) Assignee: Silmar S.p.A., Romano D'Ezzelino (IT)

( * ) Notice: Subject to any disclaimer, the term of this patent is extended or adjusted under 35 U.S.C. 154(b) by 0 days.

(21) Appl. No.: 10/221,238

(22) PCT Filed: Jan. 9, 2002

(86) PCT No.: PCT/IT02/00005

§ 371 (c)(1),
(2), (4) Date: Apr. 7, 2003

(87) PCT Pub. No.: WO02/054901

PCT Pub. Date: Jul. 18, 2002

(65) Prior Publication Data

US 2003/0150202 A1 Aug. 14, 2003

(30) Foreign Application Priority Data

Jan. 12, 2001 (IT) ..... PD2001A0005

(51) Int. Cl.[7] ..... B21L 7/00; B21F 3/04
(52) U.S. Cl. ..... 59/35.1; 59/29; 59/80
(58) Field of Search ..... 59/3, 17, 20, 29, 59/35.1, 80

(56) References Cited

U.S. PATENT DOCUMENTS 4,674,311 A 6/1987 Valtiero
4,679,391 A * 7/1987 Tizzi ..... 59/20
4,730,961 A 3/1988 Cassan
5,285,625 A * 2/1994 Ofrat et al. ..... 59/80
5,471,830 A * 12/1995 Gonzales ..... 59/80
5,531,065 A 7/1996 Rozenwasser
5,581,992 A * 12/1996 Borouchov ..... 59/29
5,611,144 A 3/1997 Gusky
5,797,258 A * 8/1998 Strobel et al. ..... 59/35.1
5,911,677 A 6/1999 Kupelian

FOREIGN PATENT DOCUMENTS

DE 43 24 387 1/1995

* cited by examiner

*Primary Examiner*—David B. Jones
(74) *Attorney, Agent, or Firm*—RatnerPrestia

(57) ABSTRACT

A method of decorating items of jewelry. The method includes the steps of bringing about a translational relative movement between the item and a cutting tool along the longitudinal axis of the item, and driving the tool with a cutting movement in contact with the surface thereof, along preselected cutting paths, in order to produce corresponding decorative marks on the surface. The method further includes the step of providing a support for the item, the support being rotatable about an axis extending along the axis of the relative translation between the tool and the item so that the tool is driven in contact with the surface during the combined and simultaneous rotary and translational movement of the item.

28 Claims, 5 Drawing Sheets

METHOD OF DECORATING JEWELRY

This application is a U.S. national-phase application of PCT International Application No. PCT/IT02100005.

TECHNICAL FIELD

The present invention relates to a method of decorating items of jewelry. The invention is also directed towards an item produced in accordance with the method, as well as towards a machine for implementing the method.

TECHNOLOGICAL BACKGROUND

In the technical field of the production of chains for items of jewelry, and in the goldsmithery field in particular, it is known to provide decorations on the surface of the chain, for example, by engraving one or more marks with a cutting tool such as a diamond cutter. Decorations of different geometrical configurations and aesthetic effects can be produced depending on the preselected speed of relative translational movement between the chain and the tool, as well as on the cutting movement of the tool itself.

This method is used effectively for all chains with so-called flat links, that is, chains in which the rectilinear profile of the surface of the chain to be decorated enables diamond engraving to be produced over the entire surface as a result of the relative transitional movement between the tool and the chain.

However, if the chain has a surface with a curved profile, the known method has clear limitations since the cutting movement of the tool enables the surface to be engraved only partially and cannot therefore be used when a decoration extending over the entire curved profile of the surface is required. This situation arises, for example, in items of jewelry formed by chains known in the art of the term "OMEGA-shaped chains," which have outer surfaces having convex curved profiles.

SUMMARY OF THE INVENTION

The technical problem upon which the present invention is based is that of providing a method of decorating items of jewelry which is designed to overcome the limitations discussed with reference to the prior art mentioned.

This problem is solved by the invention by a method of decorating items of jewelry. The method includes the steps of: (a) bringing about a translational relative movement between the item and a cutting tool along the longitudinal axis of the item, and (b) driving the tool with a cutting movement in contact with the surface of the item, along preselected cutting paths, in order to produce corresponding decorative marks on the surface of the item. The method further includes the step (c) of providing a support for the item, the support being rotatable about an axis extending in the direction of relative translation between the tool and the item so that the tool is being driven in contact with the surface during the combined and simultaneous rotary and translational movement of the item.

It is to be understood that both the foregoing general description and the following detailed description are exemplary, but are not restrictive, of the invention.

BRIEF DESCRIPTION OF THE DRAWINGS

The characteristics of the advantages of the invention will become clearer from the following detailed description of an embodiment thereof, given by way of non-limiting example, with reference to the appended drawings, in which:

FIG. 7 is a perspective view showing, on an enlarged scale, a detail of the machine of FIG. 5 operating in accordance with the variant of the above-mentioned method, and.

PREFERRED METHOD OF IMPLEMENTING THE INVENTION

Figure 1:
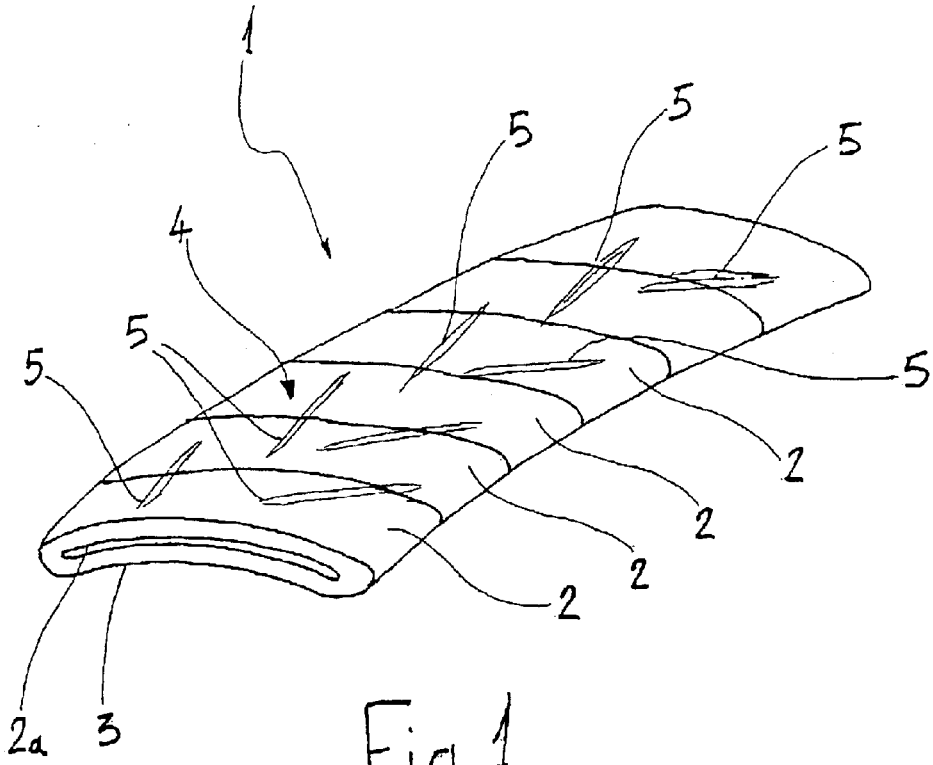
FIG. 1 is a partial perspective view showing, on an enlarged scale, a chain for items of jewelry formed in accordance with the method of the invention.
Figure 6:
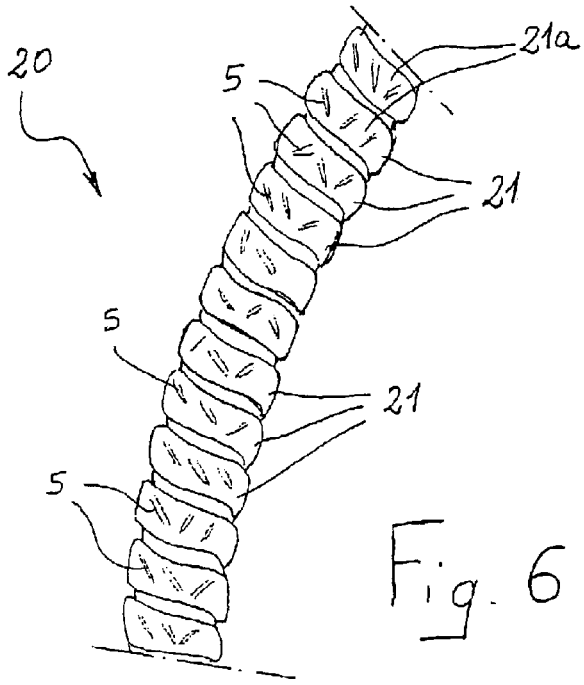
FIG. 6 is a partial plan view of an item of jewelry decorated in accordance with the variant of the method of FIG. 5.

With reference initially to FIG. 1, an item of jewelry, extending along a predominant longitudinal axis and formed as a spiral chain, is generally indicated 1 and comprises a plurality of links 2 formed in accordance with the method of the present invention and designed for the production of necklaces, bracelets and the like.

The chain 1, which is also known in the goldsmithery field as an OMEGA-shaped chain, is preferably produced by winding a ribbon-like body with a curved profile on a central core 2*a* to define the links 2 adjacent one another. The chain has a lower surface 3 adjoining an opposed convex curved surface 4 which constitutes the portion that is normally visible when the chain is worn.

The chain also has, on its surface 4, a decoration constituted by a plurality of marks, all indicated 5, which are engraved by a cutting tool 6 and are arranged in accordance with a preselected geometrical configuration produced by the method described in detail below.

Figure 2:
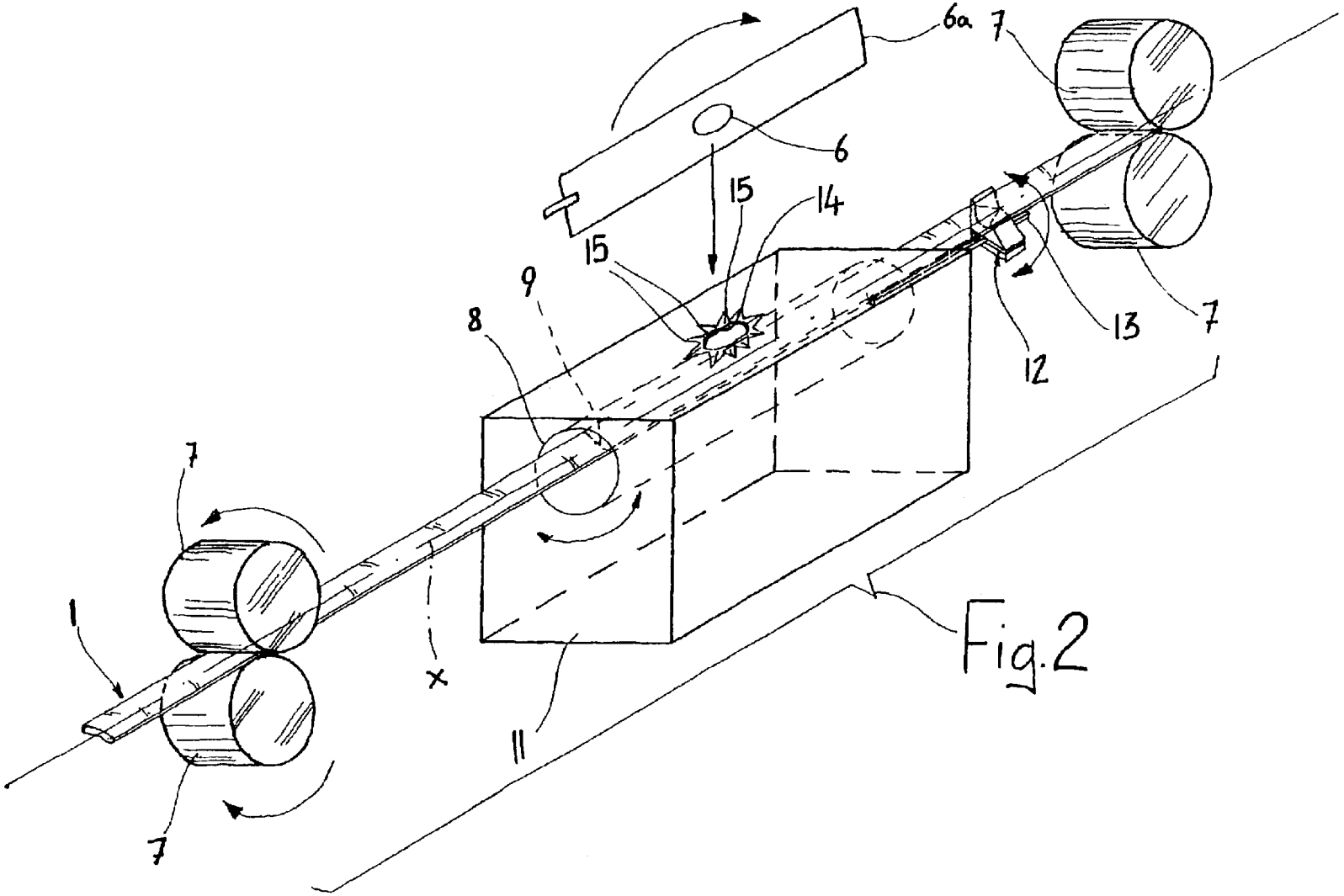
FIG. 2 is a partial schematic view of a machine operating by the method of the invention.
Figure 4:
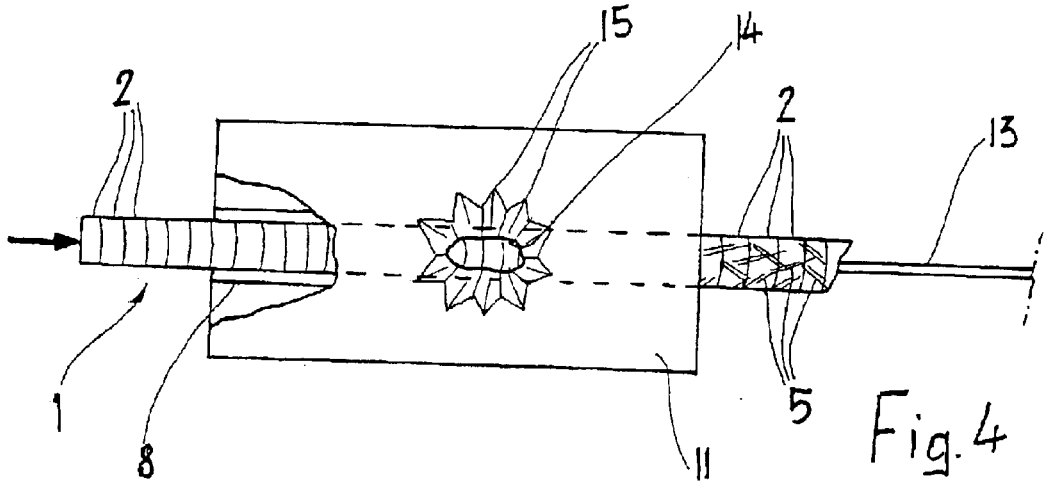
FIG. 4 is a partially-sectioned plan view of a further detail of FIG. 2.

The tool 6 is preferably a diamond cutter mounted on a tool-holder element 6*a*, shown only schematically in FIG. 2.

The method provides for a translational relative movement to be brought about between the chain 1 and the tool 6, along the longitudinal axis of the chain, indicated by the axis X of FIG. 2. In particular, the chain 1 is arranged to be pulled along the axis X, relative to the tool 6, by a pulling mechanism, for example, comprising pairs of contrarotating rollers 7 between which the chain is drawn along by friction (FIG. 2).

Figure 3:
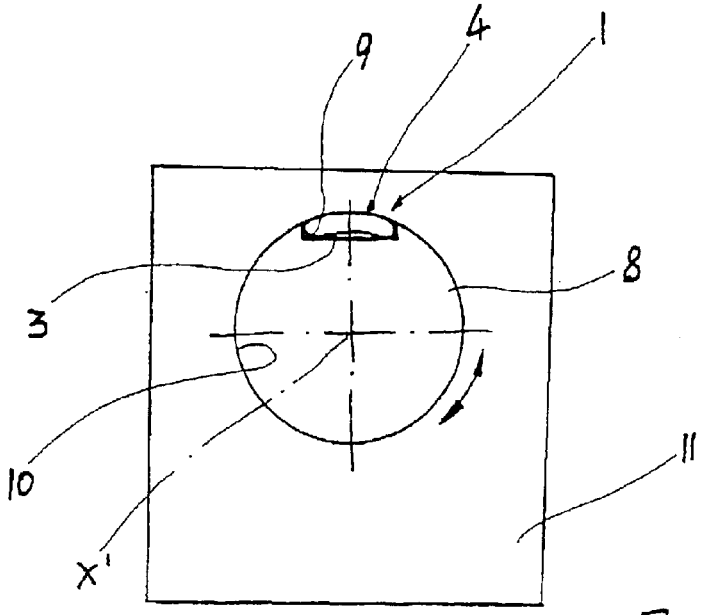
FIG. 3 is a front elevational view showing a detail of FIG. 2, on an enlarged scale.

The method also provides for the arrangement of a chain-holder support 8 in which there is a slot 9 for housing a portion of chain. The support 8 has a cylindrical shape with a circular cross-section such that the curved profile of the chain surface extends so as to be superimposed substantially on the circumferential profile of the cross-section of the support, as shown in FIG. 3. This characteristic is achieved by the use of a radius of curvature for the circular cross-section of the support which is the same as that of the curved profile of the chain surface.

According to the method of the invention, the chain-holder support 8 is housed rotatably in a seat 10 of a housing 11 and can oscillate about its axis X' of axial symmetry which extends parallel to the direction of the axis X. The oscillatory movement is brought about by a pivoting device 12 (shown schematically in FIG. 2) connected to the support 8 by a rod-like appendage 13.

The tool 6 is brought into contact with the surface 4 of the chain through an opening 14 formed in the housing 11. A plurality of recesses 15, inclined to the axis X at different angles, are formed in the housing 11, in the region of the opening 14, for the guided insertion of the tool 6 along preselected axes which are inclined to one another.

According to the method of the invention, the chain is thus subjected, simultaneously, to a translational movement along the axis X and to an oscillatory movement about the axis X', so that the entire curved surface is presented in the opening 14 and is in turn engraved by the cutting tool 6.

By virtue of the combined and simultaneous translational and oscillatory movements, the decoration by surface engraving can thus be formed on the entire curved surface of the chain, as shown in FIG. 1.

The cutting operation by the tool, which is performed, for example, by a diamond cutter, is also arranged to be of the discontinuous type.

Moreover, by virtue of the presence of the recesses 15, the tool can be guided in its contact with the surface along axes which are inclined to the axis X, thus producing marks of different inclinations, for example, in order to produce star-shaped decorative patterns.

In dependence on the speed of translation and oscillation of the chain and of the support, as well as on the inclination of the tool to the longitudinal axis of the chain, it is possible to produce decorations by diamond engraving of the surface in accordance with preselected and different geometrical configurations of excellent aesthetic effect.

The method of the invention is intended to be applicable effectively to any chain or other item of jewelry with a curved surface which requires surface decoration extending along part or all of its outer curved surface.

In a variant of the method of the invention, described with particular reference to FIGS. 5 to 8, in which details similar to those of the preceding embodiment are indicated by the same reference numerals, the decorations by diamond engraving of the above-mentioned type are produced on an item of jewelry 20 of tubular shape with a substantially cylindrical cross-section. This tubular structure is also known as a "gas-pipe" structure.

The item 20, otherwise defined below as the tubular chain, has a plurality of adjacent annular portions 21 with substantially cylindrical outer curved surfaces 21*a*. Each tubular portion 21 has, on the corresponding curved surface 21*a*, a decoration constituted by marks 5 engraved by the tool 6 and arranged in accordance with a preselected geometrical configuration.

Figure 5:
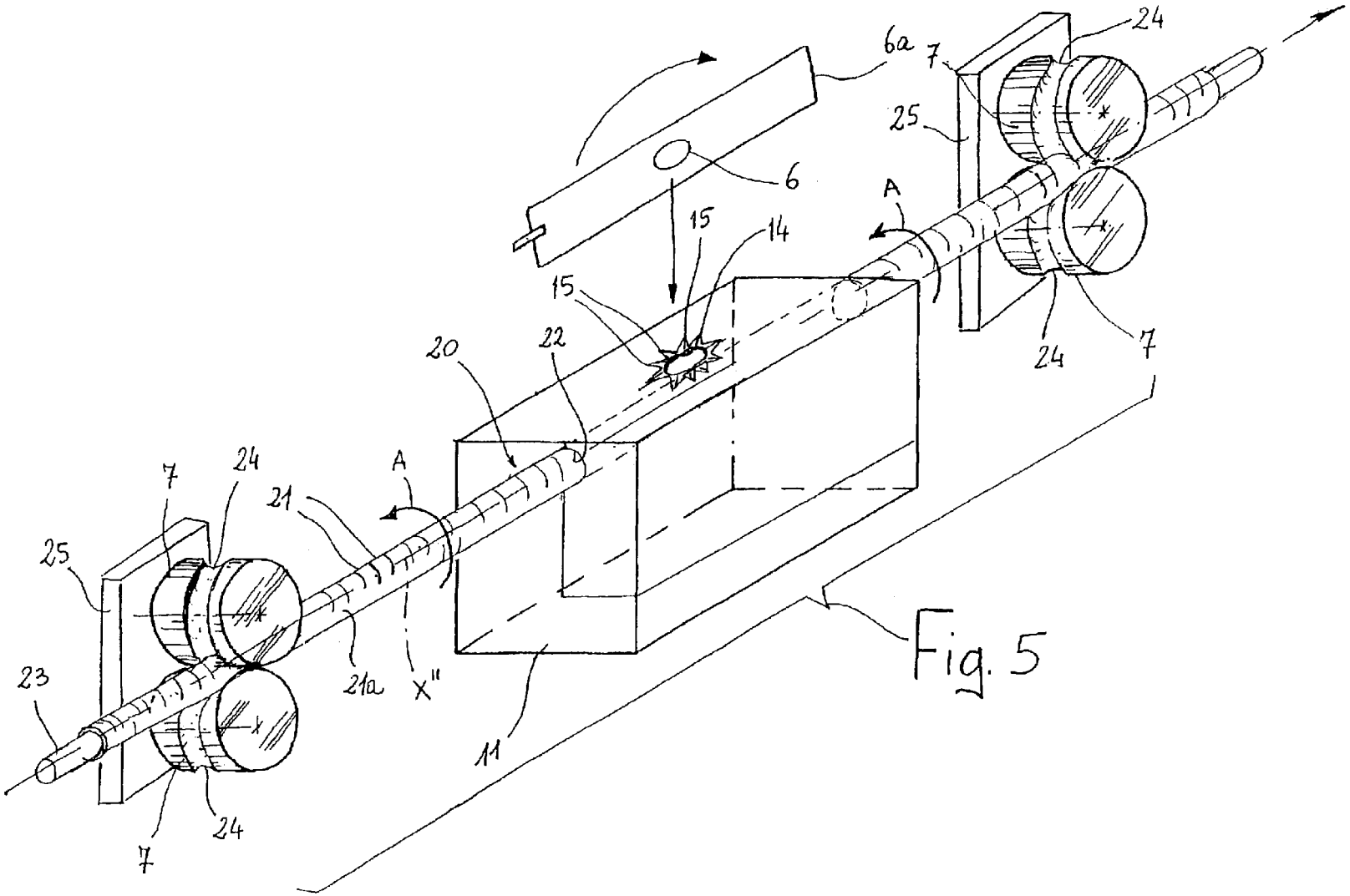
FIG. 5 is a view, corresponding to that of FIG. 2, of a machine operating in accordance with a variant of the method of the invention.
Figure 7:
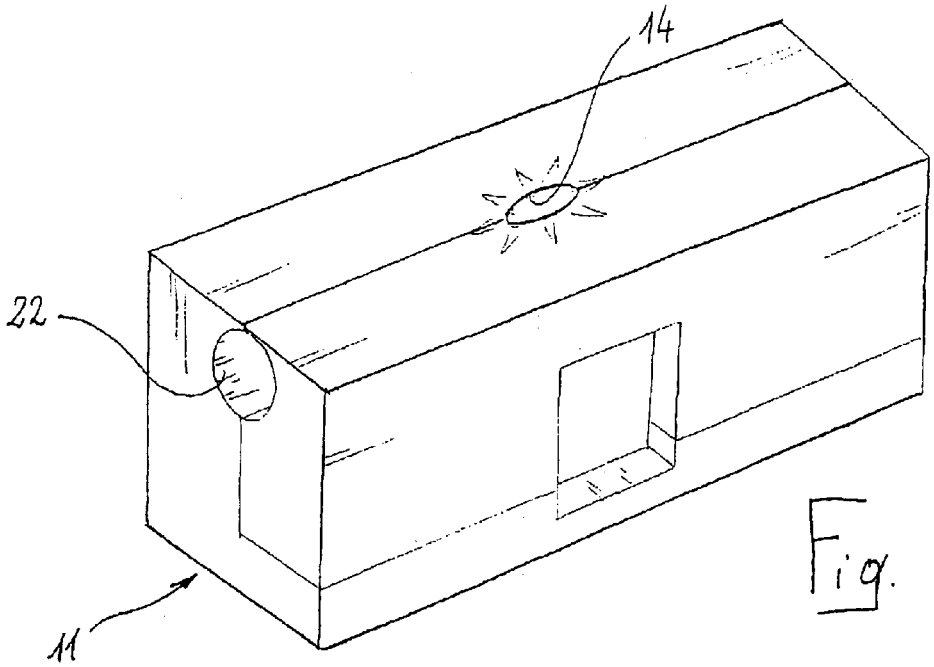
Figure 8:
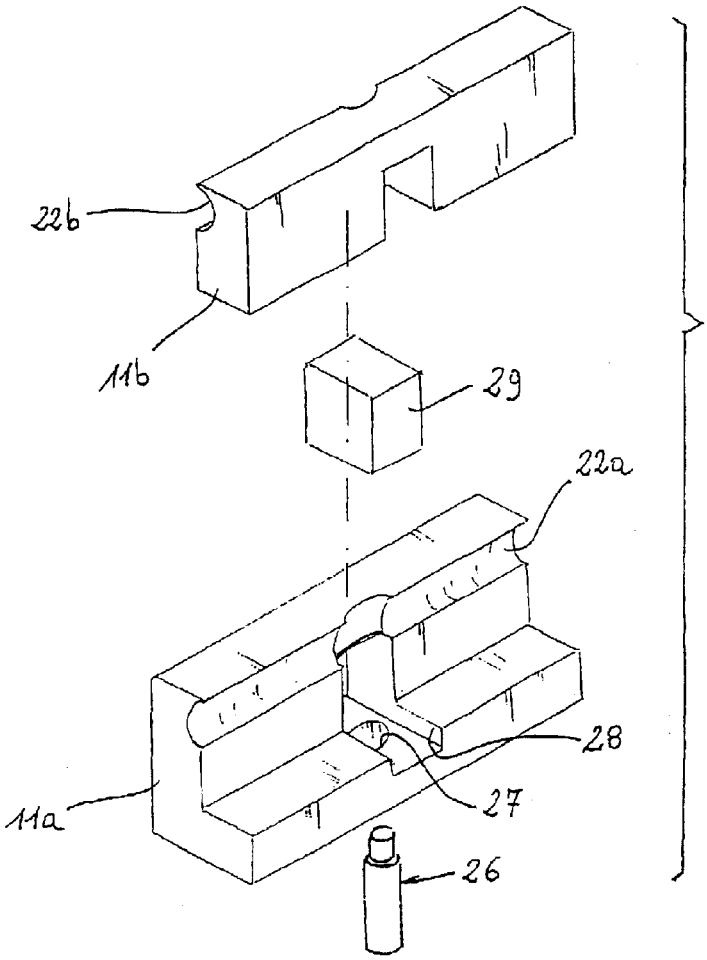
FIG. 8 is an exploded, perspective view of the detail of FIG. 7.

This variant of the invention differs from the preceding embodiment mainly in that the tubular chain is driven with rotary movement about its longitudinal axis, indicated X" in FIG. 5, in addition to its translational movement relative to the tool. For this purpose, a through-hole 22, extending along the axis X", is provided in the housing 11 for housing the tubular chain 20 rotatably with limited radial clearance.

A core, indicated 23, for example, of plastics materials such as nylon, can be inserted in the tubular cavity of the chain 20 in order to afford its sufficient stiffness during the decoration steps performed by the method of the invention.

The pairs of contrarotating rollers 7 have annular grooves 24 for partially housing the curved surface of the chain and consequently pulling it along by friction in its transitional movement along the axis X". Each pair of rollers 7 is also mounted on a respective support 25 (shown schematically in the drawing) rotating about the axis X" so that the chain is subjected simultaneously to a translational movement along the axis X and to a rotational movement about the axis X" (for example, in the direction of the arrow A of FIG. 5), the entire cylindrical surface thus being presented in the opening 14 and therefore being engraved by the cutting tool 6.

The housing 11 is preferably formed in two structural independent parts 11*a*, 11*b*, each having a half-hole 22*a*, 22*b* so that, when the parts are connected to one another, for example, by a screw, they jointly define the hole 22.

A pressing component is also provided and is positioned in the housing 11 in the region of the opening 14, for pressing the tubular chain against the inner surface of the hole 22 in opposition to the cutting forces exerted by the tool, to ensure adequate accuracy in the diamond-engraving of the chain.

The pressing component comprises a jack-like device 26, for example, a pneumatic device the rod of which extends through a hole 27 which is formed in the housing 11 and in turn communicates with a cavity 28 opening into the hole 22. A block-like element 29 is advantageously housed in the cavity 28 in a position between the pressing component and the chain for improved distribution of the pressure exerted on the curved surface of the tubular chain. As an alternative to the jack 26, the use of a spring or other similar pressing component is envisaged. This system also enables surfaces having considerable dimensional irregularities (even of the order of a few hundredths of a millimeter) to be processed.

The invention thus solves the problem posed, achieving the advantages mentioned above over known solutions.

In particular, the invention leads to the main advantage that, by surface diamond engraving over the entire extent of the surfaces of chains having curved surfaces, it is possible to produce decorations which cannot be produced by conventional methods.

Although illustrated and described above with reference to certain specific embodiments and examples, the present invention is nevertheless not intended to be limited to the details shown. Rather, various modifications may be made in the de tails within the scope and range of equivalents of the claims and without departing from the spirit of the invention.

What is claimed is:

1. A method of decorating an item of jewelry extending along a predominant longitudinal axis, comprising the steps of:

bringing about a translational relative movement between the item and a cutting tool along the longitudinal axis of the item;

driving the tool with a cutting movement in contact with the surface of the item, along preselected cutting paths, in order to produce corresponding decorative marks on the surface of the item;

providing a support for the item, the support being rotatable about an axis extending in the direction of relative translation between the tool and the item so that the tool is being driven in contact with the surface during the combined and simultaneous rotary and translational movement of the item; and oscillating the support about the axis.

2. The method according to claim 1 in which the item is pulled in its translational movement relative to the tool.

3. The method according to claim 1, in which the cutting by the tool is discontinuous.

4. The method according to claim 3, in which the cutting profile of the tool has an adjustable inclination to the direction of translation of the item so that decorative marks of preselected and different inclinations to the longitudinal axis of the item are produced on the surface of the item.

5. The method according to claim 1 in which the item has a surface with a curved profile.

6. The method according to claim 5 in which the item is substantially OMEGA-shaped in cross-section.

7. The method according to claim 5 in which the item has a tubular shape with a cross-section having a substantially circular profile.

8. The method according to claim 1 in which the cutting movement is a diamond engraving operation.

9. An item of jewelry produced in accordance with the method of claim 1.

10. The item of jewelry according to claim 9, formed as a chain with a plurality of links adjacent one another.

11. A machine for decorating items of jewelry operating in accordance with the method of claim 1.

12. A method of decorating an item of jewelry extending along a longitudinal axis, the method comprising the steps of:

(a) providing a support for the item;

(b) creating a translational relative movement between the item and a cutting tool along the longitudinal axis of the item;

(c) driving the tool with a discontinuous cutting movement in contact with the surface of the item, along preselected cutting paths, in order to produce corresponding decorative marks on the surface of the item; and (d) rotating and oscillating the support about an axis extending in the direction of relative translation between the tool and the item so that the tool is driven in contact with the surface of the item during the combined and simultaneous rotary and translational movement of the item.

13. The method according to claim 12 in which the item is pulled in its translational movement relative to the tool.

14. The method according to claim 12 in which the cutting profile of the tool has an adjustable inclination to the direction of translation of the item so that decorative marks of preselected and different inclinations to the longitudinal axis of the item are produced on the surface of the item.

15. The method according to claim 12 in which the item has a surface with a curved profile.

16. The method according to claim 15 in which the item is substantially OMEGA-shaped in cross-section.

17. The method according to claim 15 in which the item has a tubular shape with a cross-section having a substantially circular profile.

18. The method according to claim 12 in which the cutting movement is a diamond engraving operation.

19. A method of decorating an item of jewelry extending along a longitudinal axis and having a surface with a curved profile, the method comprising the steps of:

(a) providing a support for the item;

(b) pulling the item to create a translational relative movement between the item and a cutting tool along the longitudinal axis of the item;

(c) driving the tool with a discontinuous diamond engraving movement in contact with the surface of the item, along preselected engraving paths, in order to produce corresponding decorative marks on the surface of the item;

(d) rotating and oscillating the support about an axis extending in the direction of relative translation between the tool and the item so that the tool is driven in contact with the surface of the item during the combined and simultaneous rotary and translational movement of the item; and (e) adjusting the inclination of the cutting profile of the tool to the direction of translation of the item so that decorative marks of preselected and different inclinations to the longitudinal axis of the item are produced on the surface of the item.

20. A method of decorating an item of jewelry extending along a predominant longitudinal axis, comprising the steps of:

bringing about a translational relative movement between the item and a cutting tool along the longitudinal axis of the item;

driving the tool with a cutting movement in contact with the surface of the item, along preselected cutting paths, in order to produce corresponding decorative marks on the surface of the item; and providing a translationally stationary support for the item, the support having a first portion rotatable about an axis extending in the direction of relative translation between the tool and the item so that the tool is being driven in contact with the surface of the item during the combined and simultaneous rotary and translational movement of the item and the support having a second non-rotatable portion with a through hole housing the item rotatably with limited radial clearance.

21. The method according to claim 20 further comprising the step of inserting a core in a tubular cavity of the item, thereby stiffening the item against the cutting movement of the tool.

22. The method according to claim 20 further comprising the step of guiding and inserting the tool, through an opening in the second non-rotatable portion of the housing, into contact with the item.

23. The method according to claim 20 further comprising the step of pressing the item against the inner surface of the through hole against the cutting movement of the tool.

24. The method according to claim 20 in which the item is pulled in its translational movement relative to the tool.

25. The method according to claim 20, in which the cutting by the tool is discontinuous.

26. The method according to claim 25, in which the cutting profile of the tool has an adjustable inclination to the direction of translation of the item so that decorative marks of preselected and different inclinations to the longitudinal axis of the item are produced on the surface of the item.

27. The method according to claim 20 in which the item has a surface with a curved profile.

28. The method according to claim 20 in which the cutting movement is a diamond engraving operation.

* * * * *